US006954727B1

(12) United States Patent
Reagan et al.

(10) Patent No.: US 6,954,727 B1
(45) Date of Patent: Oct. 11, 2005

(54) REDUCING ARTIFACT GENERATION IN A VOCODER

(75) Inventors: John Terrence Reagan, Santa Clara, CA (US); Anna Znamerovskaya, San Jose, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/322,259

(22) Filed: May 28, 1999

(51) Int. Cl.[7] ..... G10L 19/04
(52) U.S. Cl. ..... 704/219; 704/223
(58) Field of Search ..... 704/219, 221, 704/223, 225, 226, 227, 228, 224

(56) References Cited

U.S. PATENT DOCUMENTS

| | | | | | |
|---|---|---|---|---|---|
| 5,060,269 | A | | 10/1991 | Zinser | 381/38 |
| 5,293,449 | A | * | 3/1994 | Tzeng | 704/223 |
| 5,414,796 | A | * | 5/1995 | Jacobs et al. | 704/221 |
| 5,596,680 | A | * | 1/1997 | Chow et al. | 704/248 |
| 5,633,982 | A | * | 5/1997 | Ganesan et al. | 704/223 |
| 5,664,054 | A | * | 9/1997 | Su | 704/219 |
| 5,828,996 | A | * | 10/1998 | Iijima et al. | 704/220 |
| 5,884,010 | A | * | 3/1999 | Chen et al. | 704/228 |
| 5,909,663 | A | * | 6/1999 | Iijima et al. | 704/226 |
| 6,018,707 | A | * | 1/2000 | Nishiguchi et al. | 704/222 |
| 6,272,459 | B1 | * | 8/2001 | Takahashi | 704/221 |
| 6,311,154 | B1 | * | 10/2001 | Gersho et al. | 704/219 |
| 6,324,503 | B1 | * | 11/2001 | Manjunath et al. | 704/226 |
| 6,330,532 | B1 | * | 12/2001 | Manjunath et al. | 704/219 |
| 6,484,138 | B2 | * | 11/2002 | DeJaco | 704/221 |

FOREIGN PATENT DOCUMENTS

EP 660301 A1 6/1995 ..... G10L/9/14

OTHER PUBLICATIONS

"Enhanced Variable Rate Codec, Speech Service Option 3 for Wideband Spread Spectrum Digital Systems" Enhanced Variable Rate Codec, Speech Service Option 3 for Wideband Spread Spectrum Digital Systems, Sep. 9, 1996, pp. A, I–XIV, 101–104, 201, 209, 301–303, XP002912397 *section "4.3.1 Estimating the Data Rate Based on Current Signal Parameters"*.

Kwon S Y et al: "A High Quality Bi–Celp Speech Coder at 8 kbit/s and Below" 1997 IEEE International Conference on Acoustics, Speech and Signal Processing (Cat. No. 97CB.36052), Munich, Germany, Apr. 21–24, 1997, pp. 759–762 vol. 2 XP000822558 1997, Los Alamitos, CA, USA, IEEE Comput. Soc. Press, USA. ISBN: 0–8186–7919–0 abstract p. 759, left–hand column., line 36 –right–hand column., line 6.

* cited by examiner

*Primary Examiner*—David L. Ometz
*Assistant Examiner*—Michael N. Opsasnick
(74) *Attorney, Agent, or Firm*—Aaron Waxler

(57) ABSTRACT

A method of reducing sinusoidal artifact generation in a vocoder. In one embodiment, the present invention first receives a determined input energy threshold value. The input energy threshold value is the value below which it is believed that a suspected noise-inducing codebook excitation vector will be generated by the vocoder. Next, provided that an input signal is received having an energy value lower than the input energy threshold value, the present invention uses a codebook excitation vector selection process to prevent the suspected noise-inducing codebook excitation vector from being continuously generated. In one embodiment, the codebook excitation vector selection process is a randomization codebook excitation vector selection process. In so doing, the present embodiment prevents the creation of harmonics during zero or low-energy input periods.

16 Claims, 3 Drawing Sheets

REDUCING ARTIFACT GENERATION IN A VOCODER

TECHNICAL FIELD

The present invention relates to the field of voice encoding and voice decoding. More specifically, the present invention relates to sinusoidal artifact reduction in a vocoder (voice encoder/decoder).

BACKGROUND ART

All digital telephony employs some form of speech compression (or voice encoder/decoder, herein "vocoder"). When the IS-95A standard for CDMA digital telephony was finalized, its founder developed their own variable rate vocoder and dubbed it the QCELP (Qualcomn Codebook Excitation Linear Prediction) encoder. The first generation of this vocoder was a 8 kbps vocoder, QCELP-8. Unfortunately, the quality of the QCELP-8 was not very high. To address the quality issues, the manufacturer developed a high-rate version operating at 13 kbps and called it the QCELP-13 vocoder. It is known that in the QCELP-13 specification, it is a requirement that the first frame be encoded at full-rate. Such a requirement is not present on various other vocoders including the QCELP 8.

In addition, the manufacturer of the QCELP-13 vocoder released a floating-point C-language implementation. Commercially viable silicon solutions must implement this vocoder using fixed-point arithmetic; neither the standard or the C-code reference describe how to do this. As a result of fixed-point arithmetic, there are unwanted quantization effects which must be minimized in order to achieve toll-quality speech. However, without a fixed-point reference model, two different entities (e.g. two different companies) are free to implement their unique fixed-point implementation as they see fit. Unfortunately, when this happens, there is no assurance that one company's voice encoder output will sound good through another company's voice decoder and visa versa.

In order to ensure successful interoperability of vocoder implementations from different semiconductor providers, an exhaustive procedure has been defined (Modified Methodology IS-736 Performance test) to test the subjective quality of various implementations of the same vocoder under varying operating conditions; this test is referred to as the mean opinion scoring test (herein "MOS Test"). Increasingly, as more semiconductor companies provide chipsets for code division multiple access (CDMA) voice applications, service providers are demanding proof of interoperability between multiple semiconductor providers' vocoder implementations.

As mentioned above, the vocoder specification and corresponding distributed reference floating-point C-language code fails to sufficiently address how to process zero-or low-level input speech signals when the encoding rate is determined to be full-rate. However, it is exactly these types of speech signals which stress the vocoder most and for which it is very difficult to receive a passing score on the MOS test. Specifically, conventional vocoders fail to encode the data sufficiently when the encoding rate is full-rate and one or more subframes of the source material is a zero or low-level energy signal.

It has been observed that one or more subframes of the source material is a zero or low-level energy signal in at least the following three situations. First and most prevalent, conventional vocoders force the first frame always to be encoded at full-rate. If the input file has zero or low-level input, the vocoder will produce tones at audible harmonically-related frequencies. Second, if there is a sudden, short, quiet region in between two loud regions of speech, the vocoder will produce tones at the various frequencies. In this second case, conventional approaches attempt to code the first loud region as full-rate and then when the vocoder encounters the quiet region, the vocoder ideally would switch to eighth-rate encoding. However, the instantaneous switching between full- to eighth-rate encoding is prohibited by a process referred to as "hangover processing". Simply stated, hangover processing says "If the last frames encoding rate was Rate 1 and the current frame is determined not to be a Rate 1 frame, then the next M (some integer) frames are encoded as Rate 1 before allowing the encoding rate to drop to Rate ½ (half-rate) and then to Rate ⅛ (eighth rate)". Third, due to frame offsets, a situation can occur wherein a frame is to be encoded at full-rate, but the one or more subframes (1.25 ms) of the frame contain zero or low-level input while other subframes of the same frame contain high energy. Due to this fundamental flaw with some conventional vocoders, any conventional fixed-point or floating point approach will contain audible harmonically-related frequencies when any one of the three aforementioned scenarios occur. The result being a failure of the MOS test.

Thus, a need exists for a method for use in a vocoder system wherein the method reduces the creation of undesired, audible, harmonically-related frequencies when the encoding rate is determined to be full-rate and the source material is a zero or low-level energy signal situation. Still another need exists for a method for use in a vocoder system wherein the method meets the above need and further enables successful passing of subjective listening quality tests. Yet another need exists for a method for use in a vocoder system wherein the method meets both of the above needs and does not require complete revamping of existing vocoder systems and requiring minimal impact on the code size, computational complexity (MIPS, millions of instructions per second), and RAM (random access memory) requirements.

DISCLOSURE OF THE INVENTION

The present invention provides a method for use in a vocoder system wherein the method reduces the creation of undesired, audible, harmonically-related frequencies when the encoding rate is determined to be full-rate or half-rate and the source material is a zero or low-level energy signal situation. The present invention further provides a method for use in a vocoder system wherein the method achieves the above accomplishment and further enables successful passing of subjective listening quality tests. The present invention also provides a method for use in a vocoder system wherein the method achieves both of the above accomplishments and does not require complete revamping of existing vocoder systems and has minimal impact on the code size, computational complexity (MIPS, millions of instructions per second), and RAM (random access memory) requirements.

In one embodiment, the present invention first receives a determined input energy threshold value. The input energy threshold value is the value below which it is believed that a suspected noise-inducing codebook excitation vector will be generated by the vocoder. Next, provided that an input signal is received having an energy value lower than the input energy threshold value, the present invention uses a codebook excitation vector selection process to prevent the suspected noise-inducing codebook excitation vector from being continuously generated. In one embodiment, the codebook excitation vector selection process is a randomization codebook excitation vector selection process. In so doing, the present embodiment prevents the creation of harmonics during zero or low-energy input periods.

These and other advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

Figure 1:
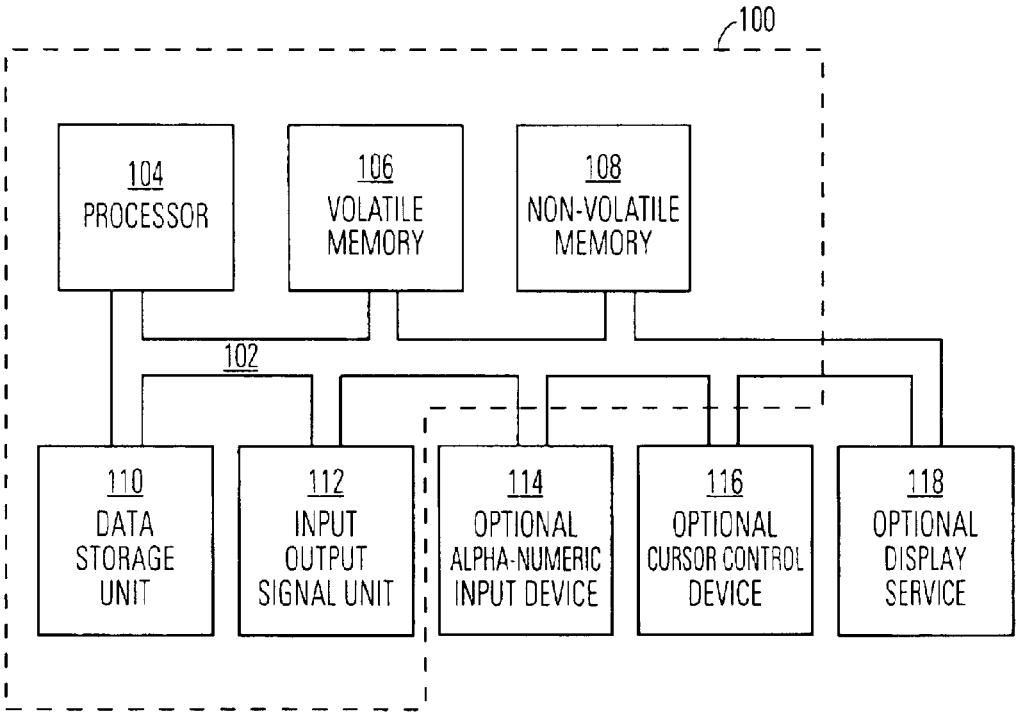
FIG. 1 is a schematic diagram of an exemplary computer system used in accordance with one embodiment of the present invention.

The drawings referred to in this description should be understood as not being drawn to scale except if specifically noted.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions which follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, etc., is conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proved convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "determining","using","calculating", or the like, refer to the actions and processes of a computer system, or similar electronic computing device. The computer system or similar electronic computing device manipulates and transforms data represented as physical (electronic) quantities within the computer system's registers and memories into other data similarly represented as physical quantities within the computer system memories or registers or other such information storage, transmission, or display devices. The present invention is also well suited to the use of other computer systems such as, for example, optical and mechanical computers.

COMPUTER SYSTEM ENVIRONMENT OF THE PRESENT INVENTION

With reference now to FIG. 1, portions of the present embodiment are comprised of computer-readable and computer-executable instructions which reside, for example, in computer-usable media of a computer system. FIG. 1 illustrates an exemplary computer system 100 used to perform the vocoder sinusoidal artifact reduction method in accordance with one embodiment of the present invention. It is appreciated that system 100 of FIG. 1 is exemplary only and that the present invention can operate within a number of different computer systems including general purpose computers systems, embedded computer systems, and stand alone layout editors or computer systems specially adapted for vocoder purposes (e.g. a hardware or software implemented vocoder).

System 100 of FIG. 1 includes an address/data bus 102 for communicating information, and a central processor unit 104 coupled to bus 102 for processing information and instructions. System 100 also includes data storage features such as a computer usable volatile memory 106, e.g. random access memory (RAM), coupled to bus 102 for storing information and instructions for central processor unit 104, computer usable non-volatile memory 108, e.g. read only memory (ROM), coupled to bus 102 for storing static information and instructions for the central processor unit 104, and a data storage unit 110 (e.g., a magnetic or optical disk and disk drive) coupled to bus 102 for storing information and instructions. A input output signal unit 112 (e.g. a modem) coupled to bus 102 is also included in system 100 of FIG. 1. System 100 of the present invention also includes an optional alphanumeric input device 114 including alphanumeric and function keys is coupled to bus 102 for communicating information and command selections to central processor unit 104. System 100 also optionally includes a cursor control device 116 coupled to bus 102 for communicating user input information and command selections to central processor unit 104. System 100 of the present embodiment also includes an optional display device 118 coupled to bus 102 for displaying information.

Optional display device 118 of FIG. 1, utilized with the present vocoder sinusoidal artifact reduction method, may be a liquid crystal device, cathode ray tube, or other display device suitable for creating graphic images and alphanumeric characters recognizable to a user. Optional cursor control device 116 allows the computer user to dynamically signal the two dimensional movement of a visible symbol (cursor) on a display screen of display device 118. Many implementations of cursor control device 116 are known in the art including a trackball, mouse, touch pad, joystick or special keys on alphanumeric input device 114 capable of signaling movement of a given direction or manner of displacement. Alternatively, it will be appreciated that a cursor can be directed and/or activated via input from alphanumeric input device 114 using special keys and key sequence commands. The present invention is also well suited to directing a cursor by other means such as, for example, voice commands. A more detailed discussion of the present vocoder sinusoidal artifact reduction method is found below.

GENERAL DESCRIPTION OF THE PRESENT VOCODER SINUSOIDAL ARTIFACT REDUCTION METHOD

Figure 2:
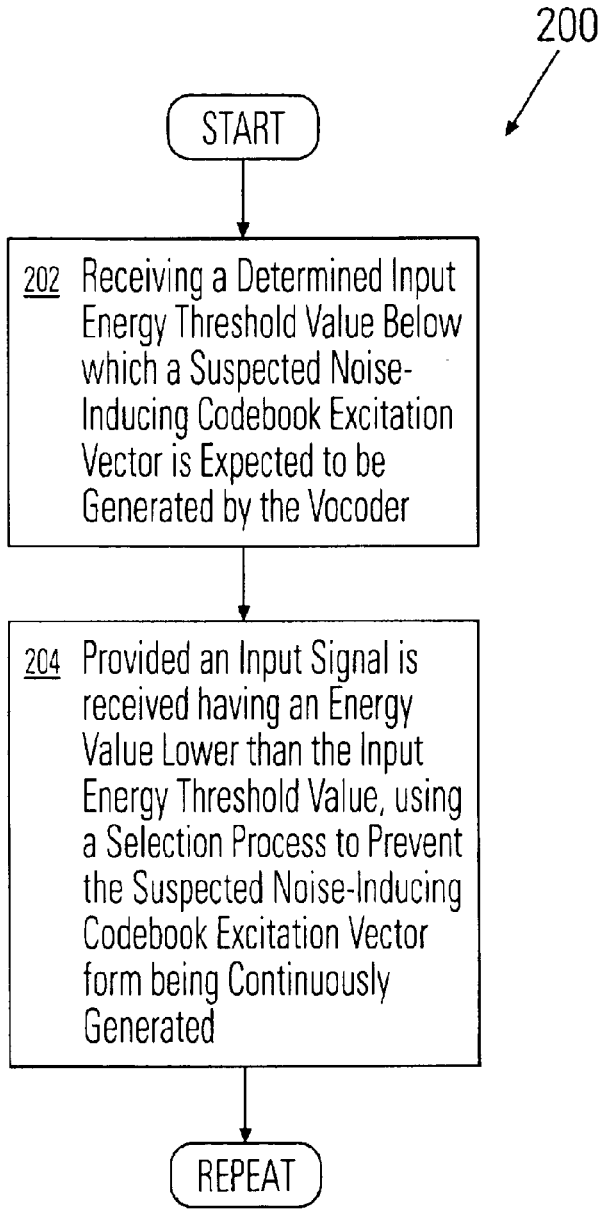
FIG. 2 is a flow chart of steps performed in accordance with one embodiment of the present claimed invention.

With reference next to FIG. 2, a flow chart 200 of steps used by the present vocoder sinusoidal artifact reduction method is shown. Flow chart 200 includes processes of the present invention which, in one embodiment, are carried out by a processor under the control of computer-readable and computer-executable instructions. The computer-readable and computer-executable instructions reside, for example, in data storage features such as computer usable volatile memory 106 and/or computer usable non-volatile memory 108 of FIG. 1. The computer-readable and computer-executable instructions are used to control, for example, the operation and functioning of central processing unit 104 of FIG. 1. It will be understood that in one embodiment, the present invention operates, for example, as a set of instructions in a fixed-point digital signal processor (DSP).

As mentioned above, it is possible for a full-rate encoded frame of speech to contain several subframes worth of zero- or low-level input. Zero-or low-level input to a CELP (codebook excitation linear prediction) based voice encoder encoding the frame as full-rate potentially results in the same codebook vector being used as the source of excitation over multiple subframes; this results in undesired, annoying tones at k*(# of codebook subframes)*(# of frames per second) Hz, k=1, 2, . . . . This prevents successful passing of subjective listening quality tests (herein "MOS Test"). The present invention provides a threshold mechanism and randomization method which eliminates the problems associated with the prior art. Although the following discussion, for purposes of example, uses the QCELP-13 vocoder as a specific example, the present invention is well suited to use with various CELP-based vocoder and other types of vocoders. For purposes of clarity the following will primarily use the term "vocoder". Additionally, in, some implementations, the present invention performs the processes described below in detail only on frames determined to be encoded at full and half rate only. In implementations wherein the vocoder is not variable rate, the processes of the present invention are performed after every frame or subframe. Hence, in the following discussion the terms full rate or half rate refer to use of the present invention in QCELP-13 type implementations.

Specifically, the current problem with the QCELP-13, and consequently various CELP-based, encoder on zero- or low-level speech signals is that the current codebook excitation vector search procedure seeks to select a noise vector to be used as the source of excitation which minimizes an objective function (i.e. a suspected noise-inducing codebook excitation vector). (In the present embodiment, it is understood that the codebook excitation vector in itself is not noise-inducing. Rather, the fact that a particular codebook excitation vector is repeated multiple times in the time domain produces audible harmonically-related frequencies in the frequency-domain. For purposes of the present discussion and in the present application, the codebook excitation vector which conventionally might be repeated multiple times is referred to as "a suspected noise-inducing codebook excitation vector"). However, in the case of a zero- or low-level input speech signal when the encoding rate is full-rate, there is not enough resolution to determine a single best excitation vector (i.e. more than one excitation vector could minimize the desired objective function). The industry standard specification fails to describe what to do in this case. As a result, the distributed C-code reference selects the first of the potential excitation vectors. If the zero- or low-level input condition persists over several subframes when the encoding-rate is full-rate, an undesired, annoying tone is produced at the output of the encoder at a frequency of at k*(# of codebook subframes)*(# of frames per second) Hz, k=1,2, . . . . For the QCELP-13 vocoder, the number of subframes varies as a function of the rate at which the current frame (20 ms) of data is being encoded. For half-rate encoding, there are 4 codebook subframes and there are 50 frames per second resulting in tones at 200 Hz, 400 Hz, 800 Hz, and 1600 Hz (i.e. various harmonic frequencies). For full-rate encoding, there are 16 codebook subframes and there are 50 frames per second resulting in tones at 800 Hz, 1600 Hz, 2400 Hz, and 3200 Hz (i.e. various harmonic frequencies). The presence of these tones is perhaps the single most prevalent reason for a MOS test failure.

In one embodiment, the present invention defines the input (i.e. an input signal) to the codebook search as s(n). After the potential codebook index is found, additional processing is performed to determine if this index should be randomized. The encoding rate is known at this point and so the sum-of-squares of s(n) is computed over the appropriate subframe interval. The number of samples per codebook subframe varies with encoding rate; there are 10, 40, 32, and 160 samples per codebook subframe for full-, half-, quarter- and eighth-rate frames, respectively. This value for the sum-of-squares is compared to a fixed threshold (i.e. a determined input energy threshold value). In one embodiment of the present invention, the threshold is currently set to a value of 4.0. The unit of this threshold value is $q^2$. When the analog speech signal (volts) is quantized by an analog-to-digital (A/D) converter, the unit becomes q. When two of these numbers are multiplied together, the resulting unit is $q^2$. This threshold is determined experimentally and is the same for all rates. In general, the threshold used in the present embodiment is rate-dependent or is scaled proportionately based on the number of samples per codebook subframe (i.e. threshold for half-rate might be ((40/10)*4.0).

The problem of the tone generation is extremely apparent on full-rate frames. In the present embodiment, if the sum-of-squares of s(n) is less than the specified threshold, then one final check is performed. If the candidate index found equals 1 (i.e. codebook index is the first of all potential indices), then randomization must be performed randomization codebook excitation vector selection process). That is, instead of selecting the candidate excitation vector, the present embodiment randomly selects various other available and appropriate codebook excitation vectors. In so doing, the present embodiment reduces the creation of sinusoidal artifacts at the aforementioned various harmonic frequencies. If the candidate index found does not equal 1 (in this case, even though the sum-of-squares was below threshold, but there was enough resolution to provide a distinct minimum to the objective function in codebook search), then no codebook randomization takes place. The present embodiment is well suited to using any one or more of the various known randomizing processes.

Listed below is an example of OAK DSP assembly code used to implement one embodiment of the present invention.

```
; Compute Exx for low-energy frame checking
    clr a0
    sqr (r0)-
    rep #CB_SUBFRAME_SIZE-1
    sqra (r0)-,a0
    cmp #TARGET_THRESHOLD,a0
    brr >0/0 Exit, gt
    cmp #ONE,a1
    call CBSearch.RandomIndex,eq
```

Referring again to FIG. 2, a flow setting forth steps employed by the above-described present invention is shown. As shown in step 202 of FIG. 2, in one embodiment, the present invention receives a determined input energy threshold value below which a suspected noise-inducing codebook excitation vector is expected to be generated by the vocoder. In one embodiment, the present invention computes on a subframe basis (recall this varies depending on the encoding rate), the sum-of-squares of the input to the codebook search procedure.

Referring still to step 202 of FIG. 2, in one embodiment, the input energy threshold value is determined, for example, experimentally, to have a value of approximately 4.0 $q^2$.

With reference now to step 204, provided an input signal is received having an energy value s(n) lower than the input energy threshold value, using a selection process to prevent the suspected noise-inducing codebook excitation vector (i.e. the same, first index, codebook vector from being repeated across multiple subsequent subframes. That is, the present embodiment prevents repeated use of the same codebook excitation vector over multiple subframes if the input energy is below the threshold and the codebook index is 1 (of 128 possible candidates) and thus, reduces or removes the generation of unwanted sinusoidal artifacts (e.g. audible harmonically-related frequencies). Hence, the quality of the vocoder of the present embodiment is improved over conventional vocoders, thereby increasing the chances for successful passing of subjective listening quality tests. Furthermore, the method of the present embodiment does not require re-designing or re-vamping of existing vocoder technology. More specifically, the method of the present embodiment is well suited for use in legacy vocoders. As an example, the method of the present embodiment is well suited for use in various CELP-based vocoders including those used in IS-95 CDMA digital communication systems.

Figure 3:
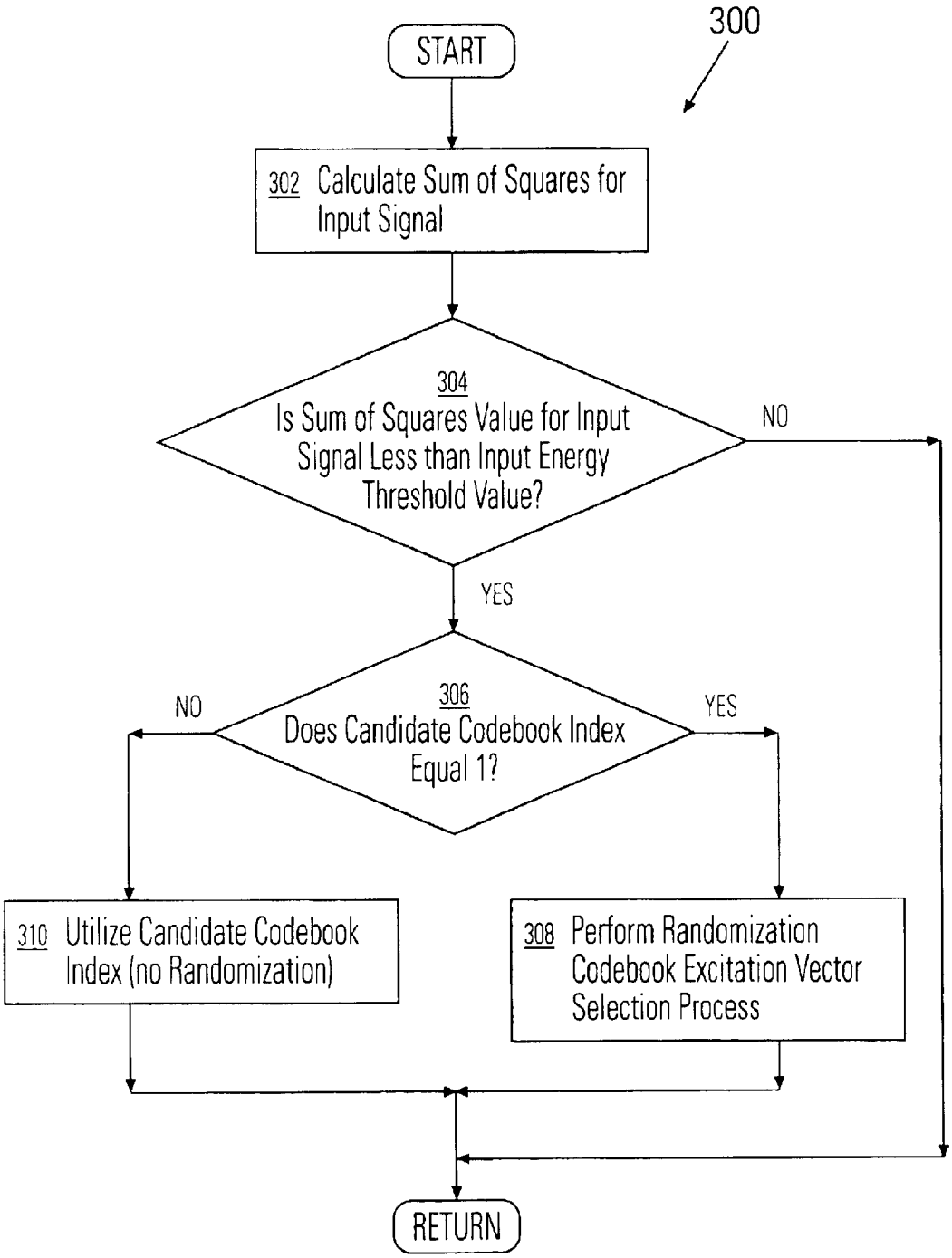
FIG. 3 is a flow chart providing a specific implementation of steps performed during portions of the process of FIG. 2 in accordance with one embodiment of the present claimed invention.

With reference now to FIG. 3, a flow chart 300 providing a specific implementation of steps performed during step 204 of FIG. 2 is shown. As shown at step 302 in one embodiment the present invention calculating a sum of squares value $s(n)^2$ for the input signal s(n).

At step 304, the present embodiment determines whether the sum of squares value for the input signal is less than the input energy threshold value received at step 202 of FIG. 2. If not, the present embodiment does not perform any randomization codebook excitation vector selection process. If so, the present embodiment proceeds to step 306.

In step 306, the present invention determines whether or not the candidate codebook excitation vector equals 1. If so, the present embodiment proceeds to step 308. If the candidate codebook excitation process does not equal 1, the present embodiment proceeds to step 310.

At step 308, the present embodiment performs a randomization codebook excitation vector selection process such that the suspected noise-inducing codebook excitation vector is prevented from being continuously generated. More specifically, in this embodiment, the present invention performs a randomization process in which the codebook index is randomized between 1 and 128. As a result, a unique codebook excitation vector is used on all subframes for which the encoding rate is full or half-rate and for which the input energy signal is below the specified threshold and for which the original codebook index was found to be 1. In so doing, the randomly generated codebook index is used as the offset into the circular codebook. This randomly generated codebook index and the encoding rate (e.g. full or half-rate) defines the codebook excitation vector.

At step 310, the present embodiment utilizes the suspected noise-inducing codebook excitation vector. That is, the present embodiment uses the candidate codebook index without any randomization process, along with the encoding rate, to define the codebook excitation vector.

Thus, the present invention provides a method for use in a vocoder system wherein the method reduces or completely removes the creation of undesired, audible, harmonically-related frequencies when the encoding rate is determined to be fill-rate and the source material is a zero or low-level energy signal situation. The present invention further provides a method for use in a vocoder system wherein the method achieves the above accomplishment and further enables successful passing of subjective listening quality tests. The present invention also provides a method for use in a vocoder system wherein the method achieves both of the above accomplishments and does not require complete revamping of existing vocoder systems and has minimal impact on the code size, computational complexity (MIPS, millions of instructions per second), and RAM (random access memory) requirements.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A computer implemented method of reducing sinusoidal artifact generation in a vocoder, said computer implemented method comprising the steps of:

a) receiving a determined input energy threshold value below which a suspected noise-inducing codebook excitation vector is expected to be generated by said vocoder; and b) provided an input signal is received having an energy value lower than said input energy threshold value, using a selection process such that said suspected noise-inducing codebook excitation vector is not continuously generated;

wherein the input signal comprises a plurality of subframes, the subframes encoded at half-rate or greater, at least a portion of the subframes have a zero or low-level input, and each of the subframes having the zero or low-level input results in a randomized selection of a single codebook excitation vector.

2. The computer implemented method of reducing sinusoidal artifact generation in a vocoder as recited in claim 1 wherein step a) comprises:

receiving said determined input energy threshold value having a value of approximately 4 $q^2$.

3. The computer implemented method of reducing sinusoidal artifact generation in a vocoder as recited in claim 1 wherein step b) comprises:

b1) calculating a sum of squares value for said input signal; and b2) provided said sum of squares value for said input signal is less than said input energy threshold value and provided that a candidate codebook index equals 1, performing a randomization codebook excitation vector selection process such that said suspected noise-inducing codebook excitation vector is prevented from being continuously generated.

4. The computer implemented method of reducing sinusoidal artifact generation in a vocoder as recited in claim 1 wherein step b) comprises:

b1) calculating a sum of squares value for said input signal; and b2) provided said sum of squares value for said input signal is less than said input energy threshold value and provided that a candidate codebook index does not equal 1, utilizing said suspected noise-inducing codebook excitation vector.

5. In a computer system having a processor coupled to a bus, a computer readable memory unit coupled to said bus and having stored therein a computer program that when executed by said processor causes said computer system to implement a method of reducing sinusoidal artifact generation in a vocoder, said method comprising the steps of:

a) receiving a determined input energy threshold value below which a suspected noise-inducing codebook excitation vector is expected to be generated by said vocoder; and b) provided an input signal is received having an energy value lower than said input energy threshold value, using a selection process such that said suspected noise-inducing codebook excitation vector is not continously generated;

wherein the input signal comprises a plurality of subframes, the subframes encoded at half-rate or greater, at least a portion of the subframes have a zero or low-level input, and each of the subframes having the zero or low-level input results in a randomized selection of a single codebook excitation vector.

6. The computer readable memory unit as described in claim 5 wherein said computer program stored therein when executed by said processor causes said computer system performing said step a) to further perform the step of:

receiving said determined input energy threshold value having a value of approximately 4 $q^2$.

7. The computer readable memory unit as described in claim 5 wherein said computer program stored therein when executed by said processor causes said computer system performing said step b) to further perform the steps of:

b1) calculating a sum of squares value for said input signal; and b2) provided said sum of squares value for said input signal is less than said input energy threshold value and provided that a candidate codebook index equals 1, performing a randomization codebook excitation vector selection process such that said suspected noise-inducing codebook excitation vector is prevented from being continuously generated.

8. The computer readable memory unit as described in claim 5 wherein said computer program stored therein when executed by said processor causes said computer system performing said step b) to further perform the step of:

b1) calculating a sum of squares value for said input signal; and b2) provided said sum of squares value for said input signal is less than said input energy threshold value and provided that a candidate codebook index does not equal 1, utilizing said suspected noise-inducing codebook excitation vector.

9. A computer system comprising:

a processor;

an address/data bus coupled to said processor;

a computer readable memory coupled to communicate with said processor, said processor for performing the vocoder sinusoidal artifact generation reduction steps of:

a) receiving a determined input energy threshold value below which a suspected noise-inducing codebook excitation vector is expected to be generated by said vocoder; and b) provided an input signal is received having an energy value lower than said input energy threshold value, using a selection process such that said suspected noise-inducing codebook excitation vector is not continuously generated;

wherein the input signal comprises a plurality of subframes, the subframes encoded at half-rate or greater, at least a portion of the subframes have a zero or low-level input, and each of the subframes having the zero or low-level input results in a randomized selection of a single codebook excitation vector.

10. The computer system as recited in claim 9 wherein at said step a) said processor performs the vocoder sinusoidal artifact generation reduction steps of:

receiving said determined input energy threshold value having a value of approximately 4 $q^2$.

11. The computer system as recited in claim 9 wherein at said step b) said processor performs the vocoder sinusoidal artifact generation 20 reduction steps of:

b1) calculating a sum of squares value for said input signal; and b2) provided said sum of squares value for said input signal is less than said input energy threshold value and provided that a candidate codebook index equals 1, performing a randomization codebook excitation vector selection process such that said suspected noise-inducing codebook excitation vector is prevented from being continuously generated.

12. The computer system as recited in claim 9 wherein at said step b) said processor performs the vocoder sinusoidal artifact generation reduction steps of:

b1) calculating a sum of squares value for said input signal; and b2) provided said sum of squares value for said input signal is less than said input energy threshold value and provided that a candidate codebook index does not equal 1, utilizing said suspected noise-inducing codebook excitation vector.

13. A method of reducing sinusoidal artifact generation in a vocoder, said method comprising the steps of a) determining an input energy threshold value below which a suspected noise-inducing codebook excitation vector is expected to be generated by said vocoder, and b) provided an input signal is received having an energy value lower than said input energy threshold value, using a selection process such that said suspected noise-inducing codebook excitation vector is not continuously generated;

wherein the input signal comprises a plurality of subframes, the subframes encoded at half-rate or greater, at least a portion of the subframes have a zero or low-level input, and each of the subframes having the zero or low-level input results in a randomized selection of a single codebook excitation vector.

14. The method of reducing sinusoidal artifact generation in a vocoder as recited in claim 13 wherein step a) comprises:

determining said input energy threshold value to be approximately $4\ q^2$.

15. The method of reducing sinusoidal artifact generation in a vocoder as recited in claim 13 wherein step b) comprises:

b1) calculating a sum of squares value for said input signal; and b2) provided said sum of squares value for said input signal is less than said input energy threshold value and provided that a candidate codebook index equals 1, performing a randomization codebook excitation vector selection process such that said suspected noise-inducing codebook excitation vector is prevented from being continuously generated.

16. The method of reducing sinusoidal artifact generation in a vocoder as recited in claim 13 wherein step b) comprises:

b1) calculating a sum of squares value for said input signal; and b2) provided said sum of squares value for said input signal is less than said input energy threshold value and provided that a candidate codebook index does not equal 1, utilizing said suspected noise-inducing codebook excitation vector.

* * * * *